US010358330B2

(12) United States Patent
Anglade

(10) Patent No.: US 10,358,330 B2
(45) Date of Patent: Jul. 23, 2019

(54) SCISSOR ARM ASSEMBLY FOR A SCISSOR LIFTING MECHANISM OF AN AERIAL WORK PLATFORM

(71) Applicant: HAULOTTE GROUP, L'horme (FR)

(72) Inventor: Pierre Anglade, Saint-Etienne (FR)

(73) Assignee: HAULOTTE GROUP, L'horme (FR)

( * ) Notice: Subject to any disclaimer, the term of this patent is extended or adjusted under 35 U.S.C. 154(b) by 86 days.

(21) Appl. No.: 15/567,366

(22) PCT Filed: Apr. 15, 2016

(86) PCT No.: PCT/FR2016/050879
§ 371 (c)(1),
(2) Date: Oct. 17, 2017

(87) PCT Pub. No.: WO2016/170251
PCT Pub. Date: Oct. 27, 2016

(65) Prior Publication Data

US 2018/0162707 A1 Jun. 14, 2018

(30) Foreign Application Priority Data

Apr. 18, 2015 (FR) ..... 15 53475

(51) Int. Cl.
*B66F 11/04* (2006.01)
*B66F 3/22* (2006.01)
(Continued)

(52) U.S. Cl.
CPC ..... *B66F 11/042* (2013.01); *B66F 3/22* (2013.01); *B66F 7/0666* (2013.01); *B66F 9/127* (2013.01)

(58) Field of Classification Search
CPC .. B66F 11/042; B66F 3/22; B66F 5/00; B66F 5/02; B66F 5/025; B66F 7/00;
(Continued)

(56) References Cited

U.S. PATENT DOCUMENTS 136,883 A 3/1873 Von Ehren
2,402,579 A * 6/1946 Ross ..... B66F 3/22 182/15
(Continued)

FOREIGN PATENT DOCUMENTS

WO 90/01456 A1 2/1990

OTHER PUBLICATIONS

Extract of Spare parts manual of ITECO PE120 et al. (Publication No. 794.12 1/92): see particularly p. 8 of the PDF file (names 'Scissor components' and referenced '01 129').
(Continued)

*Primary Examiner* — Colleen M Chavchavadze
(74) *Attorney, Agent, or Firm* — 24IP Law Group USA, PLLC; Timothy R DeWitt

(57) ABSTRACT

The invention relates to a scissor arm assembly for a scissor lift, comprising two scissor arms (124, 125) pivotally mounted about a shaft (70). Each arm is made of a tubular beam having a local reinforcement plate (80, 81, 82) welded on either side. Each arm (124, 125) has two through-holes (101, 102; 103, 104) for the shaft (70), each of which is made in a respective side of the beam and the corresponding reinforcement plate. The shaft (70) is circumferentially supported in each hole by both the wall of the beam and the corresponding reinforcement plate (80, 81, 82). The shaft is free of support inside the beam between the two through-holes (101, 102; 103, 104). This avoids having to weld, on either side of the scissor beam, a part inserted therein to house the shaft (70).

20 Claims, 8 Drawing Sheets

(51) Int. Cl.
*B66F 7/06* (2006.01)
*B66F 9/12* (2006.01)

(58) Field of Classification Search
CPC ..... B66F 7/065; B66F 7/0666; B66F 7/28; B66F 9/127; E04G 1/22
See application file for complete search history.

(56) References Cited

U.S. PATENT DOCUMENTS 2,921,645 A * 1/1960 Morrow ..... E06C 1/54 182/157
3,442,351 A * 5/1969 Dennis ..... E04G 1/22 182/141
3,596,735 A * 8/1971 Denier ..... B66F 11/042 182/148
3,623,707 A * 11/1971 Klopp ..... B66F 7/0608 187/269
3,920,096 A * 11/1975 Fisher ..... B66F 11/042 182/14
RE29,542 E * 2/1978 Richards ..... B66F 7/065 187/269
4,175,644 A * 11/1979 Sikli ..... B66F 3/22 182/141
5,113,972 A 5/1992 Haak
5,145,029 A 9/1992 Blasdell et al.
5,476,050 A 12/1995 Zimmer et al.
8,500,098 B2 * 8/2013 Li ..... B66F 7/14 254/100
8,740,191 B2 * 6/2014 Litcher ..... B66F 3/22 254/122
8,919,735 B2 * 12/2014 Rosenboom ..... B66F 11/042 254/93 R
9,644,378 B2 * 5/2017 Knox ..... E04G 1/22
9,828,221 B2 * 11/2017 Mohr ..... B66F 7/065
2006/0180403 A1 * 8/2006 Hanlon ..... B66B 9/0815 187/269
2008/0105498 A1 5/2008 Perkins
2018/0251354 A1 * 9/2018 Mohlman ..... B66F 11/042

OTHER PUBLICATIONS

Extract of Spare parts manual of ITECO PE92 et al. (Publication No. C.U791U1 10/92), p. 8 ('Scissor components' and referenced '01 129').

* cited by examiner

55

35
51
53
43
34
45
40
44
24
52
50
42
54
25

SCISSOR ARM ASSEMBLY FOR A SCISSOR LIFTING MECHANISM OF AN AERIAL WORK PLATFORM

The present invention relates to the field of personnel mobile lifting platforms, further commonly called aerial work platforms. It more particularly relates to scissor lifts.

Scissor lifts are machines intended to allow one or several persons to work at height. They comprise a chassis, a work platform and a mechanism for lifting the work platform. The chassis is mounted on wheels to allow displacement of the aerial work platform on the ground. The work platform comprises a deck surrounded by a guardrail. It is provided for receiving one or several persons and also optionally loads such as tools or other equipment, materials like paint, cement, etc. The work platform is supported by the lifting mechanism which is mounted on the chassis. The lifting mechanism gives the possibility of lifting the work platform from a lowered position on the chassis up to the desired working height, generally by means of one or several hydraulic cylinders. Depending on the relevant models, the maximum working height generally varies between 6 and 18 meters.

FIGS. 1 and 2 illustrate such an aerial work platform of the prior art which is marketed by the applicant in its range called Optimum: the chassis is referenced as 1 therein, the scissor lifting mechanism 2, the work platform 3, the hydraulic cylinder for actuating the lifting mechanism of the work platform 4.

As this is well visible in the enlarged view of FIG. 3, the scissor lifting mechanism comprises pairs of tubular beams jointed together in their center like scissors, a plurality of such scissors being mounted one above the other through their jointed ends together: cf. the four pairs (21, 22), (23, 24), (25, 26) and (27, 28). These four pairs of stacked scissors form a first set of stacked scissors. As this is the most frequent case, the scissor mechanism comprises a second set of stacked scissors which is identical with the first set and parallel to the latter while being laterally shifted relatively to the first: cf. the four pairs (31, 32), (33, 34), (35, 36) and (37, 38). The fact of resorting to two sets of parallel scissors ensures the horizontal stability of the work platform. This is referred to as a two scissors aerial work platform in this case. In this case, the lifting mechanism 2 comprises 4 stages of scissors indicated by the references 11 to 14, but it may have more or less of them. Scissor beams are also designated commonly as scissor arms.

The hydraulic cylinder 4 is mounted through its two ends to the sets of scissors, each at another stage of scissors. In this way, the cylinder gives the possibility for opening and closing the scissors for lifting and lowering the work platform. For other aerial work platforms of the prior art, one of the ends of the hydraulic cylinder 4 is mounted on the chassis of the aerial work platform. In order to allow the opening and the closing of the scissors, the lower ends of two homologous beams of the first stage 11 are pivotally mounted on the chassis 1 through a shaft 15 while the lower ends of both other homologous beams of the same stage are crossed by a shaft 16 which is slidably mounted on the chassis 1. Similarly, the upper ends of two homologous beams of the last stage 14 are pivotally mounted below of the work platform 3 through a shaft 17 while the lower ends of the two other homologous beams of the same stage are crossed by a shaft 18 which is slidably mounted under the work platform 3.

In order to give overall rigidity to the lifting mechanism and avoid deformations of both assemblies of scissors in the lateral direction of the aerial work platform, the latter are connected together generally to all the stages. More specifically, the inner beams of a same stage of scissors are rigidly connected together through spacers so as to form a single block assembly. FIG. 4 illustrates the case of inner beams 24 and 34 of the second stage of scissors 12 which are connected together through a respective spacer 40, 41 to each end. A third spacer connecting the inner beams is arranged in their center for the other stages of scissors 11, 13 and 14, because it does not interfere with the cylinder 4. As this is visible in FIG. 5, these spacers are mounted in holes made in the inner beams. More specifically, the spacers cross the inner beams and are welded on each side of the inner beams.

Moreover, these spacers have a cylindrical section and are used as a mounting housing to each end for a respective pivot shaft 42, 43 for the corresponding inner and outer arms 24, 25 and 34, 35. The pivot shafts 42, 43 are blocked in the spacer by a respective bolt 44, 45. The outer beams 25, 35 each comprise a passage hole in which is accommodated a bushing 50, respectively 51. The bushings 50, 51 are welded on each side onto the corresponding outer beam 25, respectively 35. The bushings 50, 51 define the housing for mounting the pivot shafts 42, 43 respectively. For this, the bushings 50, 51 are each provided with a smooth bearing ring 52, 53 respectively. A respective elastic ring 54, 55 blocks the sliding of the outer arms 25, 25 on the corresponding pivot shaft 42, 43.

On the market, there exist other scissor lifts wherein the connecting spacers of the inner beams of the scissor lifting mechanism do not receive the pivot shafts of the inner and outer beams. In this case, the spacers are welded on the inner beams to a location shifted relatively to the passages of the pivot shafts of the beams. The latter are each received in inner beams by means of a bushing fixed in a passage hole similarly to the case of the outer arms.

The manufacturing of such a lifting mechanism is in practice delicate and expensive. Indeed, the passages of the pivot shafts in the inner and outer beams have to be positioned in an accurate way, this all the more that the positioning defects are passed on from one scissor stage to the other. Otherwise, the lifting mechanism may be subject to early fatigue. Now, the welding operations both of the bushings in the scissor beams and of the connecting spacers in or on the inner beams, depending on whether they are used as a housing for the pivot shafts or not, lead to deformations of the beams and of the single block assemblies formed by the inner arms of each scissor stage. These deformations lead to relative positioning defects of the pivot shaft housings that it is indispensable to limit to a maximum. Moreover, the weld beads at the boss of the bushings or of the spacers crossing the beams may be the center of significant stress concentrations which limit by as much their lifetime in fatigue. Consequently, it is generally necessary to resume, once the welding operations are completed, the bore holes of the welded bushings in the beams and, if relevant, those of the welded spacers in the inner beams at their two ends used for accommodating the pivot shafts in order to notably control the level of mechanical stresses in the shafts and in the weld beads of the bushings and of the spacers on the beams. In the case of the spacers, the machining is even more complicated because of the bulkiness of the single block assembly formed by the inner beams connected together.

As regards the mounting, in the scissor beams, of the bushings accommodating the pivot shafts, US 2008/0105498 A1 proposes replacement of welding by a plastic deformation operation of the ends of the bushing after mounting in the passage hole of the beam in order to maintain it in place in the beam. This solution may pose difficulties in terms of accuracy of the parts. Further, it requires placement of a spacer in the beam through which the bushing is received, which makes the manufacturing more complex of the scissor beam. It is also necessary to produce an aperture in the tubular beam for introducing therein the spacer, which weakens the beam. Alternatively, beams must be used with a U-profile which has lesser mechanical strength than the tubular beams.

The object of the present invention is to overcome at least partly the aforementioned drawbacks.

For this purpose, the present invention proposes, according to a first aspect, an assembly of scissor arms for a scissor lifting mechanism of the work platform of an aerial work platform, comprising a first scissor arm and a second scissor arm mounted together pivotally around a shaft crossing both arms, wherein:

- each of the arms is formed with a tubular beam which has:
  - a first local reinforcement plate welded on the outer surface of a first side of the beam; and
  - a second local reinforcement plate welded on the outer surface of a second side of the beam which is opposite to the first side of the beam;
- each of the arms has:
  - a first shaft passage hole made in the first reinforcement plate and the first side of the beam, and
  - a second shaft passage hole made in the second reinforcement plate and the second side of the beam;
  - wherein:
  - the shaft is circumferentially supported in the first passage hole both by the beam and the first reinforcement plate;
  - the shaft is circumferentially supported in the second passage hole both by the beam and the second reinforcement plate; and
  - the shaft is free of any support inside the beam between the first passage hole and the second passage hole.

It is actually unnecessary that the pivot shaft be supported on the whole width of the scissor beam as this is generally the case in the prior art. It will be understood that one skilled in the art will dimension the reinforcement plates, in particular their thickness, so as the width of the passage holes is suitable for properly supporting the pivot shaft which is received taking into account the mechanical stresses to which they will be subject within the aerial work platform.

This way of producing the assembly of the scissor arms avoids resorting to housing parts of the pivot shafts which cross right through the scissor beams and which are welded on them on each side. In other words, it exempts resorting, as this was the case in the prior art, to bushings for accommodating the pivot shafts mounted in the scissor beams and welded on either side of the latter, as well, in the case of two scissors aerial work platforms, the fact of causing penetration and crossing of the scissor beams by spacers connecting the inner arms which are welded to them on either side. Given that the shape and the size of the reinforcement plates are not directly imposed by those of the pivot shaft or of a part receiving the shaft as this is the case of the bushing or the spacer in the prior art, the latter may be selected by one skilled in the art so as to limit the stress concentrations in the welding bead which connects them to the beams in order to improve its lifetime in fatigue. From this point of view, the length of the welding bead—which is determined by the perimeter of the reinforcement plates—may be advantageously selected greater than that of the welding bead usually applied at the boss of the bushings or of the spacers crossing the beam in the case of the prior art. Moreover, unlike US 2008/0105498 A1, the solution of the invention gives the possibility of using a tubular beam without having to weaken it with apertures.

The two passage holes of the shaft may advantageously be made—or completed in the case of pre-piercing—after the welding operation of the reinforcement plates. In this way, the possible deformations of the beam due to the welding will not have any influence on the positioning of the passage holes. Moreover, the operations for machining the passage holes are minimized since the cumulated depth of both passage holes of the shaft is less than the width of the scissor beam contrary to the case of bushings or spacers in the prior art.

Of course, how to produce the assembly of scissor arms according to the invention may be used for each of the pivoting connections between an arm and other arms. It is advantageous that all the pivot connections between an arm with other arms are made in this way.

In the case of two scissors aerial work platforms, it is particularly advantageous to combine the assembly of the scissor arms according to the invention with a rigid connection solution of the inner beams with each other without any weld. It may nevertheless also be used with its own advantages in the case when the spacers are welded on the inner beams at locations shifted from the shafts. In this case, the machining of the passage holes of the pivot shafts in the inner arms is preferentially achieved after welding the spacers.

It will be understood that the assembly of the scissor arms according to the invention may also be used for single scissors aerial work platforms, i.e. which only comprise a single set of stacked scissors.

According to preferred embodiments, the assembly of scissor arms according to this first aspect of the invention comprises one or several of the following features:

- the shaft is blocked in translation relatively to both arms;
- the shaft is blocked in rotation relatively to the first arm;
- a respective smooth bearing ring is arranged in the first passage hole and in the second passage hole of the second arm;
- a stop element is attached removably to the first arm and interferes with the shaft by shape cooperation for stopping the translation of the shaft relatively to the first arm;
- the stop element interferes with the shaft by shape cooperation for also blocking the shaft in rotation relatively to the first arm;
- the shaft has at least one groove engaged by the stop element for blocking the shaft both in translation and in rotation relatively to the first arm;
- the stop element is attached to the first arm with screws;
- the stop element has the shape of a plate;
- the assembly comprises a mounting plate for an actuator of the scissor lifting mechanism, the mounting plate being mounted to the first arm;
- an end of the mounting plate is mounted to the first arm by means of the shaft, the mounting plate being mounted on the shaft and sandwiched between the stop element and the first arm;
- the assembly comprises at least one second shaft by means of which an end of the mounting plate is mounted to the first arm and wherein:
  - the beam forming the first arm has:
    - a third local reinforcement plate welded on the outer surface of the first side of the beam;

a fourth local reinforcement plate welded on the outer surface of the second side of the beam;

a first passage hole of the second shaft made in the third reinforcement plate and the first side of the beam and in which the second shaft is circumferentially supported both by the beam and the third reinforcement plate; and a second passage hole of the second shaft made in the fourth reinforcement plate and the second side of the beam and in which the second shaft is circumferentially supported both by the beam and the fourth reinforcement plate; and the mounting plate is mounted on the second shaft and sandwiched between the first arm and a second stop element removably attached to the first arm, the second stop element interfering with the second shaft by shape cooperation for blocking the translation of the second shaft relatively to the first arm;

the second stop element is identical with the first stop element;

the assembly comprising two other scissor arms mounted together pivotally around the shaft, the two other arms being axially distant from the first and second arms, the two other scissor arms being identical with the first and second scissor arms and maintained on the shaft in the same way as the first and second scissor arms.

According to a second aspect, the invention proposes an aerial work platform, comprising a chassis, a work platform and a scissor lifting mechanism mounted on the chassis and supporting the work platform for displacing it in height, wherein the scissor lifting mechanism comprises at least one assembly of scissor arms according to the first aspect. It is advantageous that all the scissor arms at their pivot connection areas with the other scissor arms of the lifting mechanism and how they are assembled in a pivoting way are achieved according to the assembly of scissor arms as defined according to the first aspect of the invention.

Other aspects, features and advantages of the invention will become apparent upon reading the description which follows of a preferred embodiment of the invention, given as an example and with reference to the appended figure.

FIGS. 1 and 2 each illustrate a perspective view of a same two scissors aerial work platform of the prior art, its work platform being respectively in the lowered position and in the raised condition.

Figure 6:
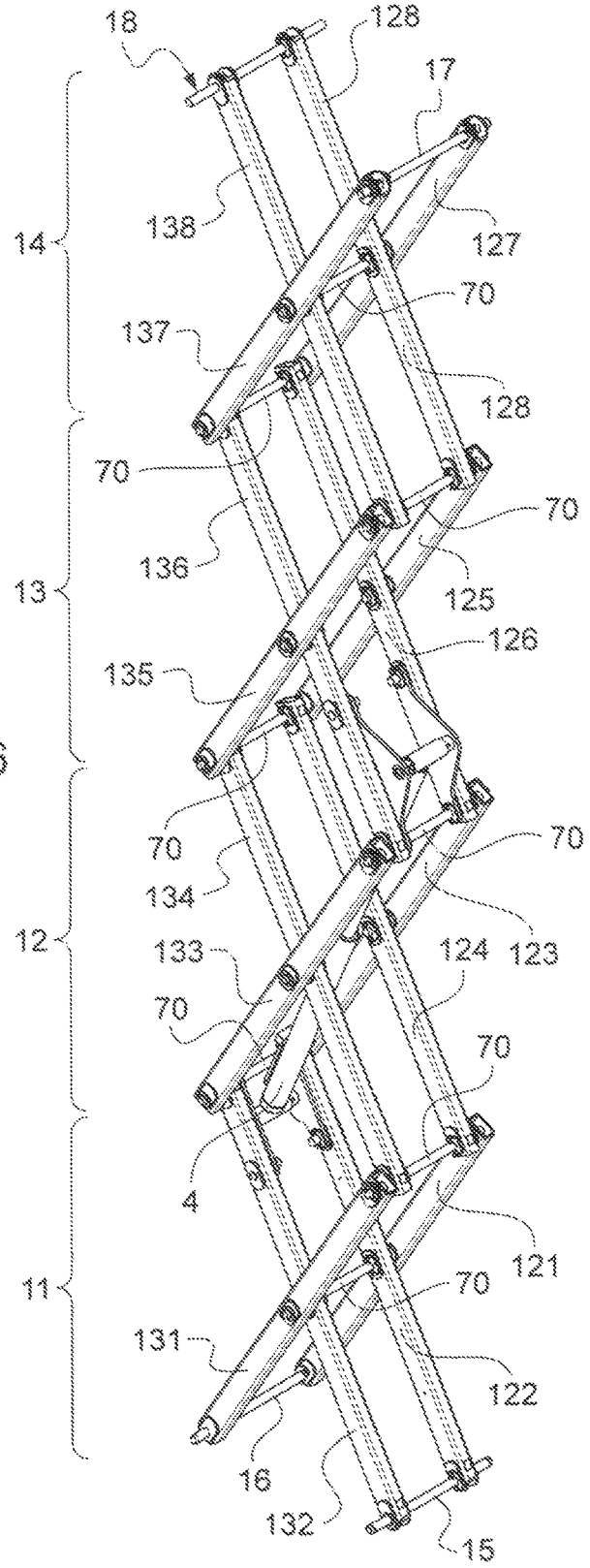
FIG. 6 is a perspective view of the lifting scissor mechanism according to an embodiment of the invention which is intended to replace that of FIG. 3, for the aerial work platform of FIGS. 1 and 2, the latter being observed from a point of view placed on the other side of the lifting mechanism relatively to FIG. 3.
Figure 8:
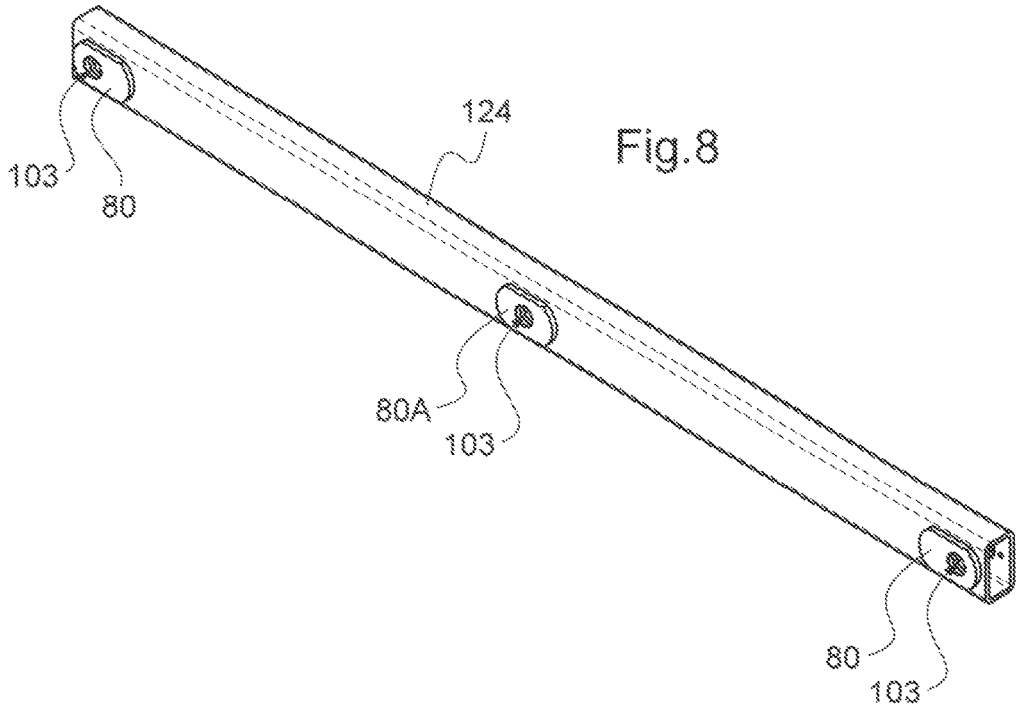
Figure 9:
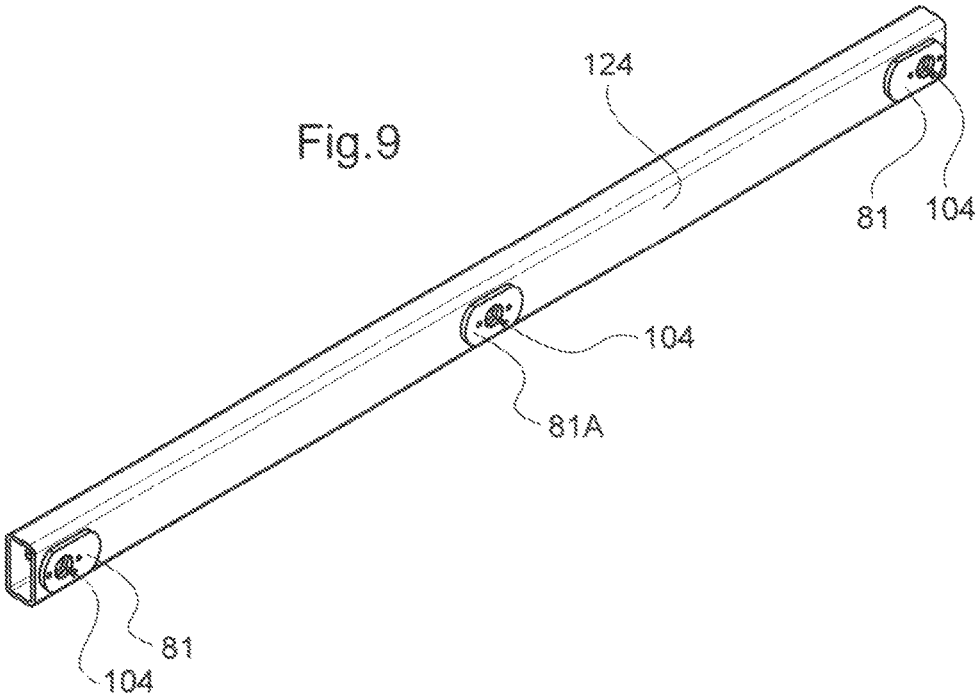

FIGS. 8 and 9 each represent a perspective view of an inner arm of scissors of the second stage of the lifting mechanism of FIG. 6, the first showing the side towards the outside of the aerial work platform and the second showing the side towards the inside of the aerial work platform, i.e. the side of the arm which faces the other set of stacked scissors.

Figure 7:
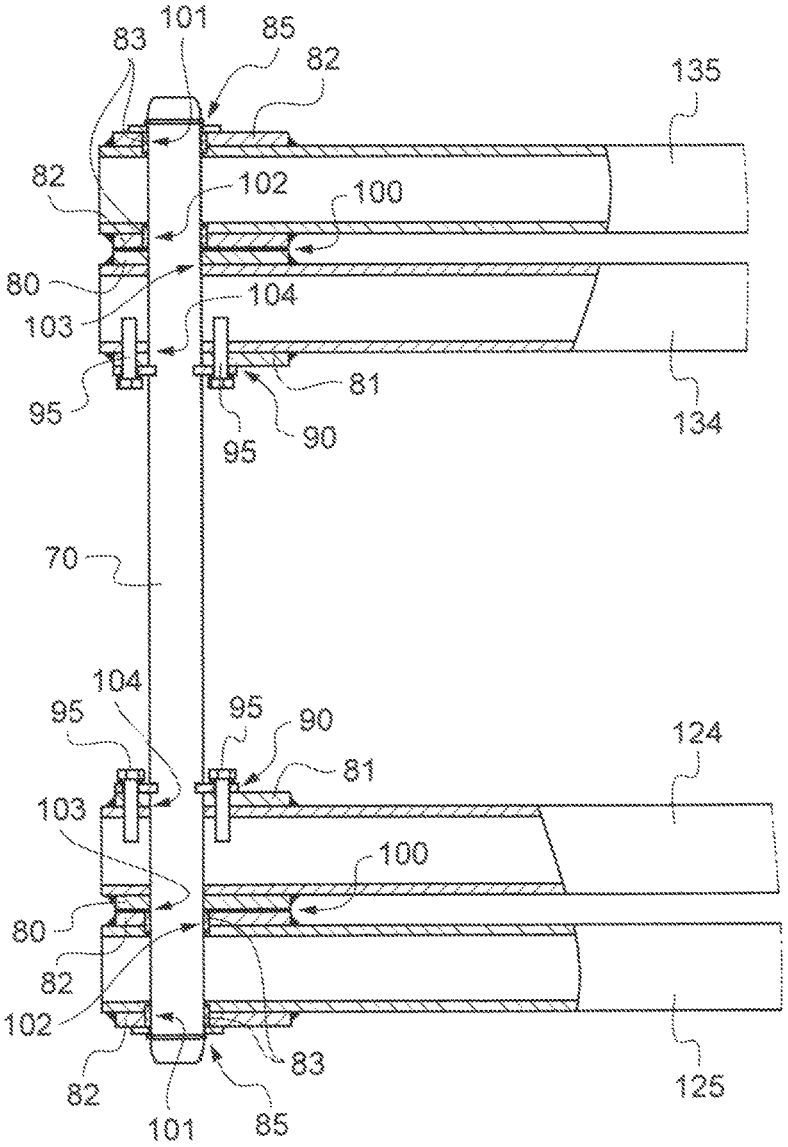
FIG. 7 is a partial sectional view showing the assembly of two arms of inner scissors of the second stage with both outer arms of the third stage of the lifting mechanism of FIG. 6.
Figure 10:
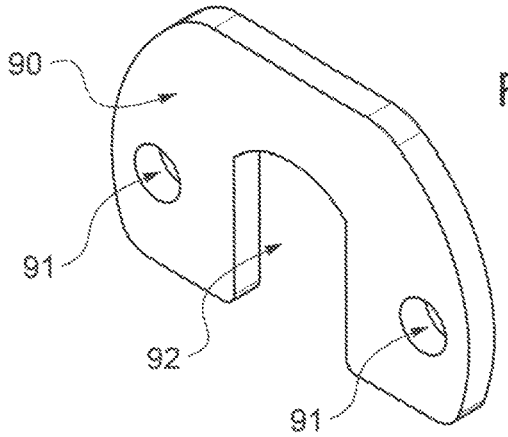

FIG. 10 is a perspective view of a stop plate used in the assembly illustrated by FIG. 7.

Figure 11:
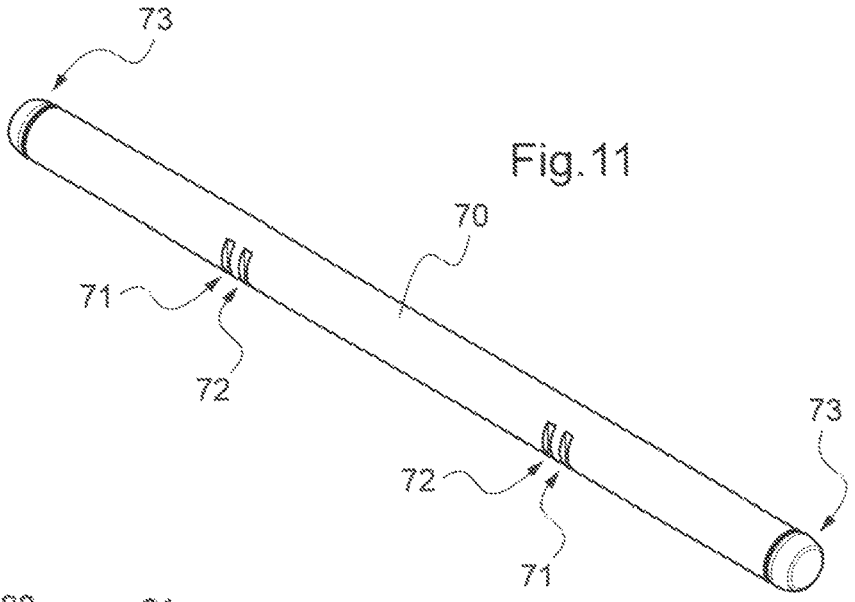

FIG. 11 is a perspective view of an arm pivot shaft of the lifting mechanism of FIG. 6.

Figure 12:
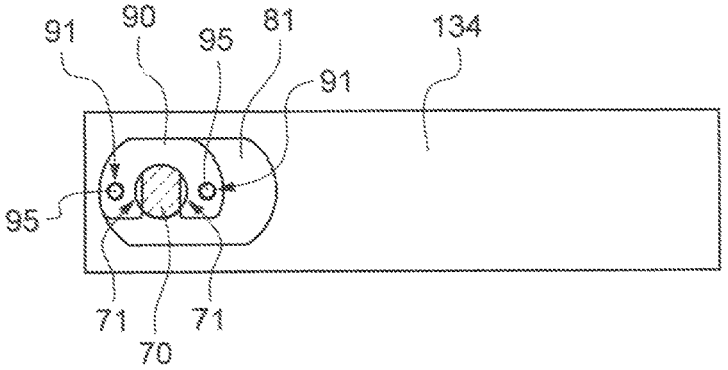

FIG. 12 is a local sectional view made perpendicularly to the pivot shaft at one of the stop plates of the portion of the assembly shown in FIG. 7.

Figure 13:
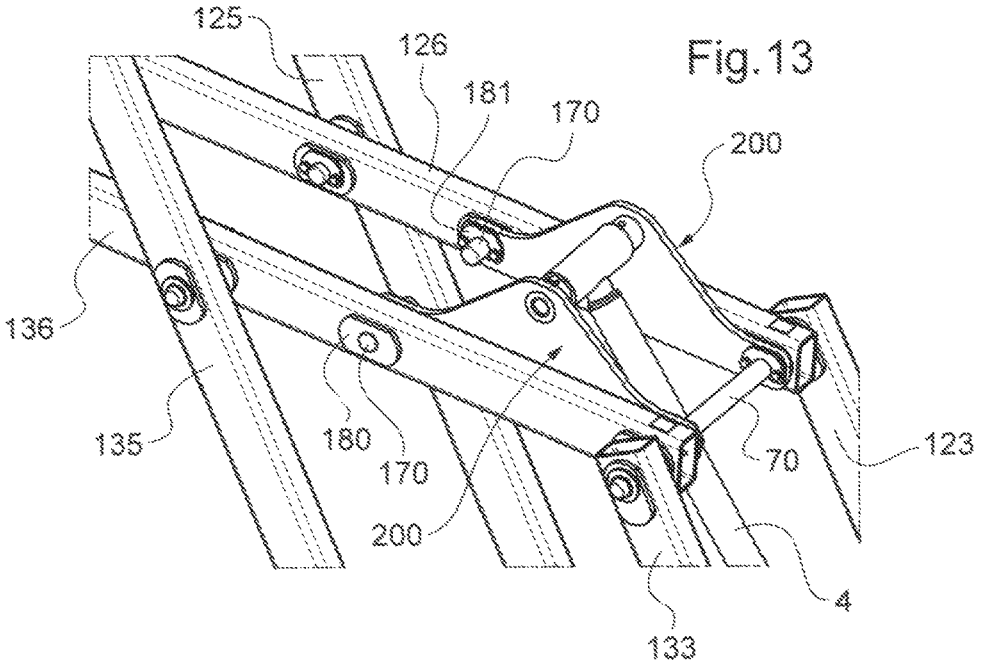

FIG. 13 is a perspective local view of the lifting mechanism of FIG. 6 made at the plates for mounting an end of the hydraulic cylinder for actuation.

Figure 14:
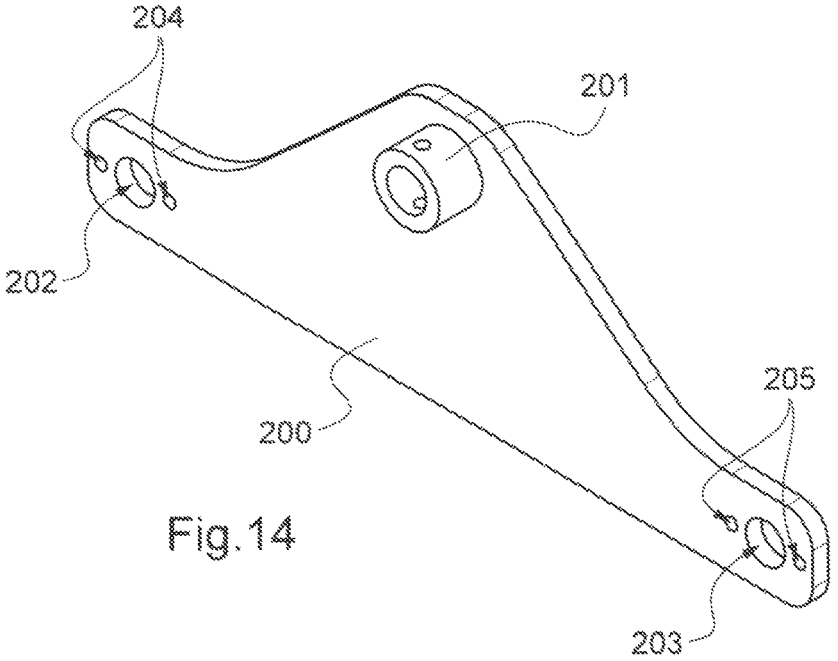

FIG. 14 is a perspective view of one of the plates for mounting a cylinder as visible in FIG. 13.

Figure 15:
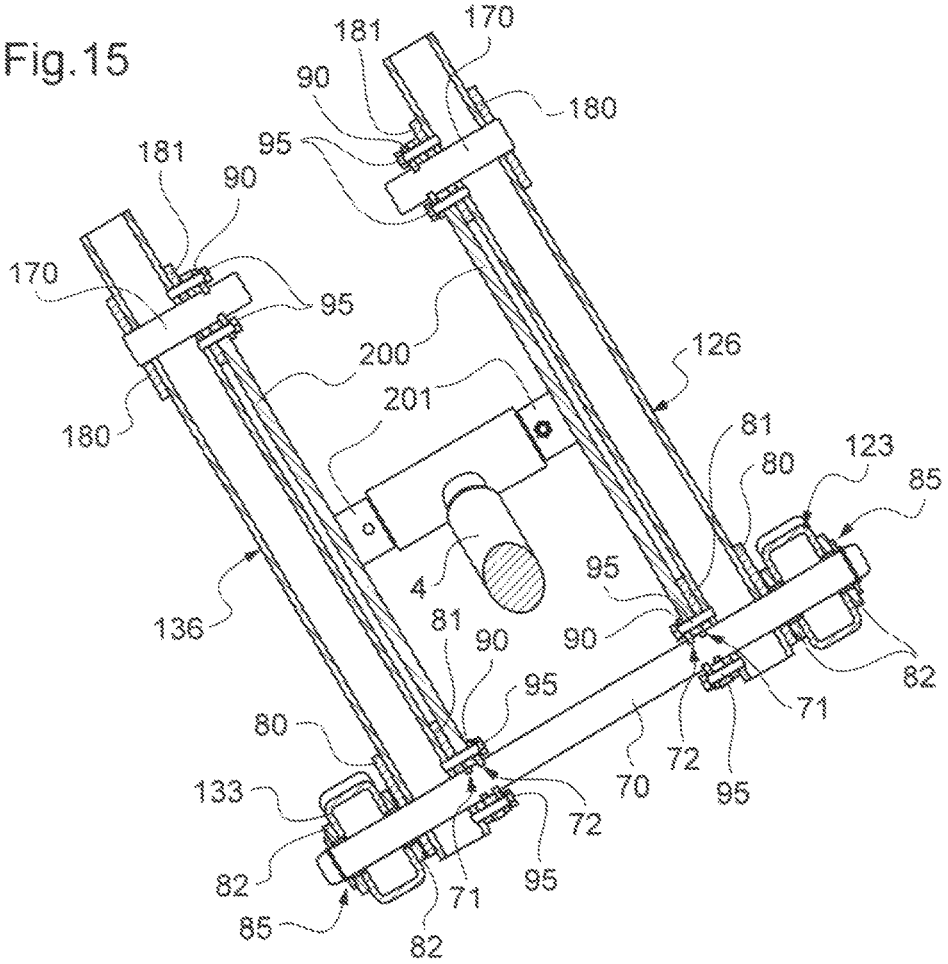

FIG. 15 is a local sectional view through the arms to which are mounted the mounting plates of the cylinder of FIG. 13.

We shall describe hereafter a preferred embodiment of the invention with reference to FIGS. 6 to 15.

Figure 1:
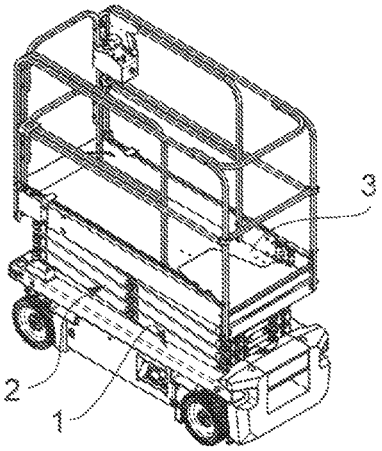
Figure 2:
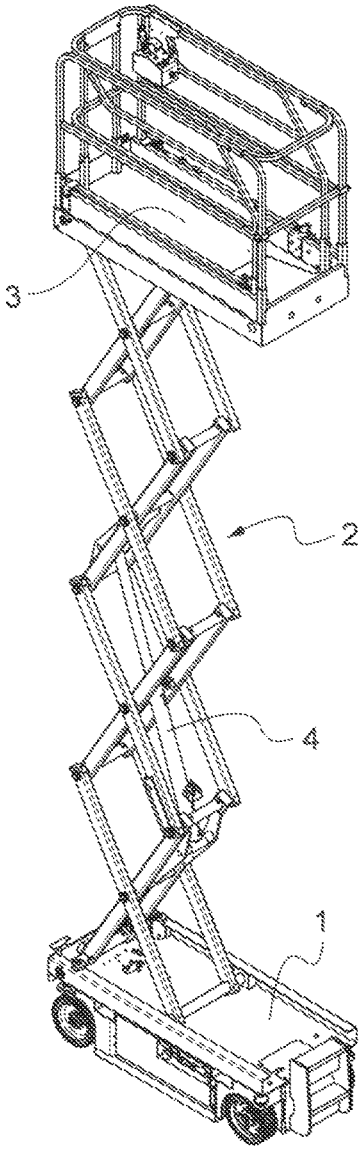
Figure 3:
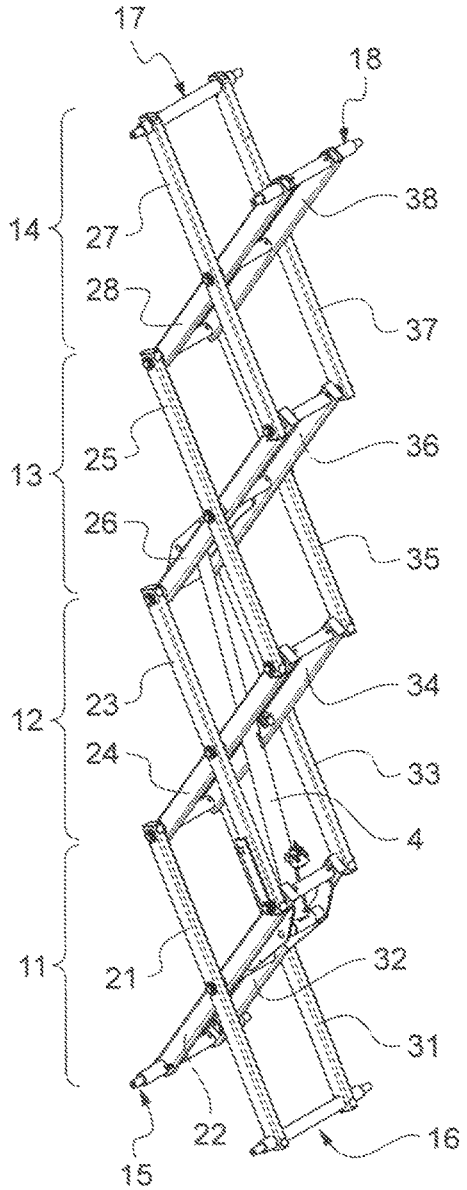
FIG. 3 is a perspective view of the scissor lifting mechanism of the aerial work platform of FIGS. 1 and 2.
Figure 4:
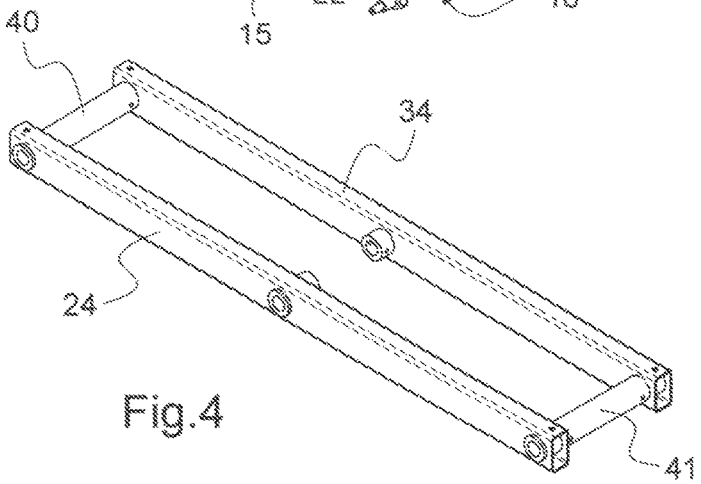
FIG. 4 is a perspective view of the single block assembly formed by the inner beams of the second scissor stage of the lifting mechanism of FIG. 3.
Figure 5:
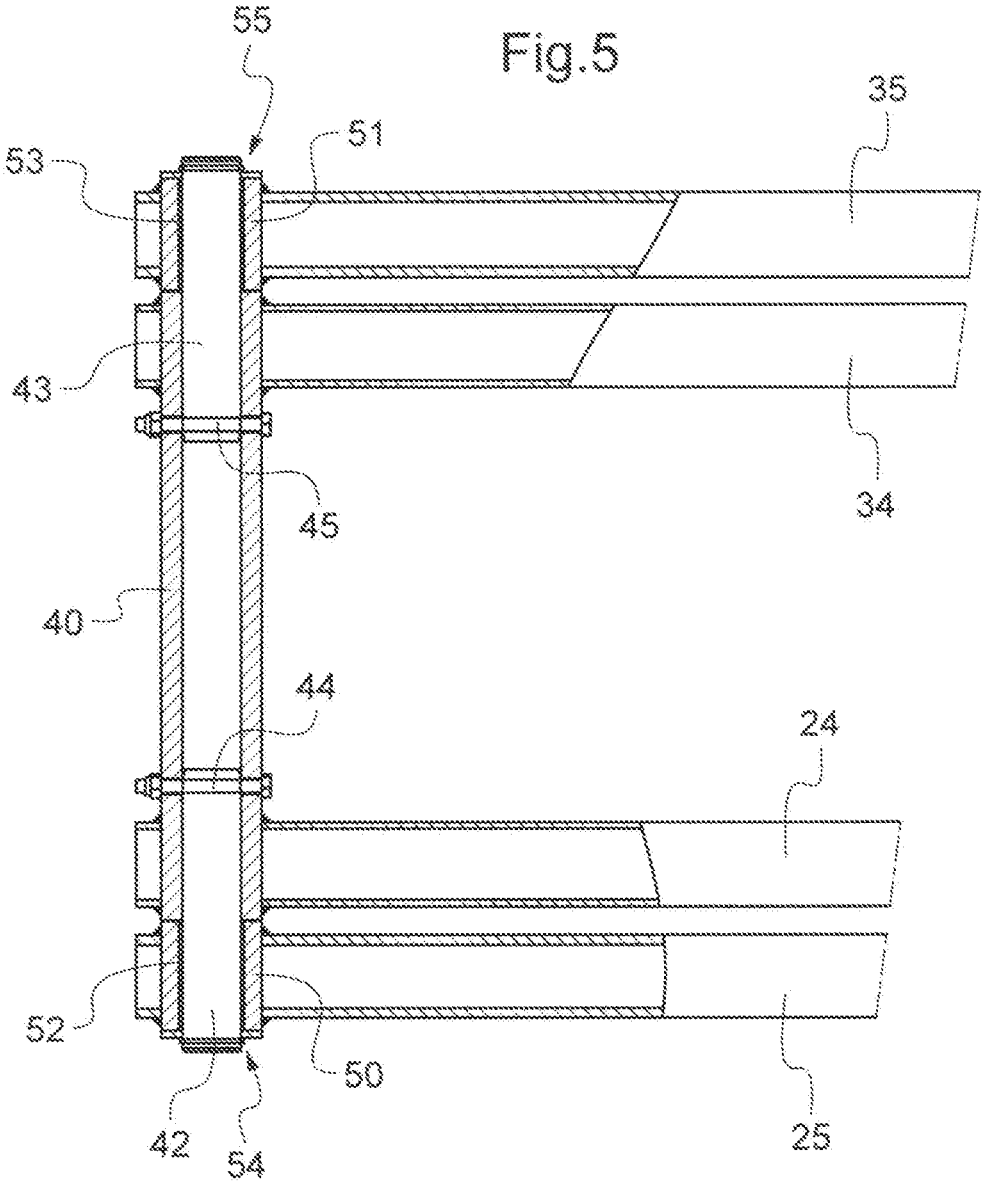
FIG. 5 is a partial sectional view of the assembly, at one end, of the single block assembly of FIG. 3 with the outer beams of the third scissor stage.

FIG. 6 shows an overall view of the scissor lifting mechanism which is provided in order to be substituted with that of the prior art of FIG. 3 in the aerial work platform of FIGS. 1 and 2.

The general configuration of the lifting mechanism is similar to that of FIG. 3. Like the latter, it comprises two sets of parallel scissors and at a distance from each other. Each set of scissors comprises pairs of tubular beams jointed together in their center like scissors, a plurality of such scissors being mounted one above the other through their ends jointed with each other: cf. the four pairs (121, 122), (123, 124), (125, 126) and (127, 128) defining the first set of stacked scissors and the four pairs of scissors (131, 132), (133, 134), (135, 136) and (137, 138) defining the second set of stacked scissors. The section of the tubular beams is preferentially rectangular or square, but may be different. The lifting mechanism also comprises four stages of scissors referenced from 11 to 14, but there may be more or less of them. The shafts 15 and 16 mounted at the lower ends of the beams of the first stage 11 intended to be mounted on the chassis 1 with a pivot connection for the first and a sliding connection for the second are also found therein. In the same way, the shafts 17 and 18 mounted at the upper ends of the beams of the last stage 14 intended to be mounted under the work platform 3 with a pivot connection for the first and with a sliding connection for the second are again found here. The hydraulic cylinder 4 for actuating the mechanism of the scissors which is mounted between the first and the third scissor stages 11, 13 are also found here. Alternatively, the cylinder 4 may be mounted between other scissor stages or further between the chassis 1 and one of the scissor stages. Several cylinders 4 may also be provided instead of a single one, each of which can be mounted at different scissor stages.

Subsequently, we shall describe the specificities of the lifting mechanism of FIG. 6.

With reference to FIGS. 7 to 12, we shall more particularly describe the structure of the scissor arms and how to assemble them in a pivoting way together, as well as how both sets of parallel scissors are connected rigidly with each other.

FIG. 7 shows the structure of the inner beam 124 and of the outer beam 125 of the first set of stacked scissors at their pivot connection, as well as how to assemble them. The same applies for the inner beam 134 and the outer beam 135 of the second set of stacked scissors. We shall limit the description to the case of the beams 124, 125 since the structure of the beams 134, 135 and their pivoting assembly are identical. More generally, the structure of all the beams of scissors at their different pivot connection areas with the other scissor beams of the lifting mechanism and how to assemble them in a pivoting way are preferentially always the same. Consequently, the description hereafter is valid for any pivot connection between any scissor beam with another scissor beam of the lifting mechanism, whether this is a connection in their central portion or in their end portion, the possible differences of implementation being mentioned if required.

FIGS. 8 and 9 show in an isolated way the beam 124 of both sides, it being specified that this description is also valid for the beam 134. The three passage holes for the pivot shafts which cross the beam 124 right through are also distinguished therein: one at each end for the pivot connection mounting with the beams 121 and 125 and one which is central for the pivot connection mounting with the beam 123. At each shaft passage, a reinforcement plate is welded on each side of the beam 124 preferably over the whole contour of the reinforcement plate: cf. the reinforcement plates 80 and 81 at each passage of an end shaft of the beam and the reinforcement plates 80A, 81A at the central shaft passage of the beam 124. The reinforcement plates 81 are identical with the reinforcement plates 80, but they are crossed further by two tappings—visible but not referenced—which also cross the side of the beam 124 on which they are welded. These tapping holes are intended for receiving screws 95 visible in FIG. 7. The reinforcement plates 80A and 81A are identical with the reinforcement plates 80 and 81 respectively, except to be noted that the shaft passage is centered while the shaft passage is off-centered for the reinforcement plates 80 and 81 because of its arrangement towards the end of the beam. The tappings are symmetrically placed on either side of the shaft passage in the case of plates 81 and 81A.

Each of the shaft passages is formed with two shaft passage holes 103, 104. The shaft passage hole 103 is defined by the hole crossing the whole of the reinforcement plate 80, respectively 80A and the wall of the side of the beam 124 on which it is welded. Similarly, the shaft passage hole 104 is defined by the hole crossing the whole of the reinforcement plate 81, respectively 81A and the wall of the side of the beam 124 on which it is welded.

With reference to FIG. 7, the shaft passage defined by the holes 103, 104 of the beam 124 is crossed by a pivot shaft 70. The shaft 70 is circumferentially supported in the first passage hole 103 both by the reinforcement plate 80 and the wall of the beam 124 on which it is welded. Similarly, the shaft 70 is circumferentially supported in the second passage hole both by the reinforcement plate 104 and the wall of the beam 124 on which it is welded. It is visible in FIG. 7 the fact that the shaft passage of the beam 124 is without any bushing or similar part connecting both opposite walls of the beam 124 contrary to the case of the prior art. In other words, the scissors arm formed by the beam 124 with its reinforcement plates 80, 81 circumferentially supports the shaft exclusively by means of the two passage holes 103, 104. Consequently, one skilled in the art will select the thickness of the reinforcement plates 80, 81, respectively 80A, 81A, in an appropriate way so that the pivot shaft 70 is supported under satisfactory conditions by both passage holes 103, 104.

The outer scissor arms formed by the beams 125, 135 are preferably identical with the inner ones 124, 134, with two exceptions that we will mention hereafter.

The beams 125, 135 each have a reinforcement plate 82 welded on each side of the beam at the shaft passage crossed by the shaft 70, but—a first difference—there are no tappings for receiving the screws 95.

The reinforcement plates 82 are preferably identical with the reinforcement plates 80. Like for the beam 124, each of the shaft passages is formed with two shaft passage holes 101, 102. All the considerations mentioned above concerning the circumferential support of the shaft 70 in the shaft passage holes 103, 104 are also valid for the shaft passage holes 101, 102, except the specification—second difference with the beam 124—that a respective smooth bearing ring 83 is mounted in each shaft passage hole 101, 102 for reducing the friction with the shaft 70. As this is visible in FIG. 7, each smooth bearing ring 83 is axially stopped towards the inside of the beam 125 with a shoulder made in the corresponding shaft passage hole 101, 102. This difference is related to the fact that the beam 125 is free to pivot around the shaft 70 while it is blocked in rotation relatively to the beam 124 as this will be seen. Alternatively, the shaft passage holes 101, 102 are without any smooth bearing rings, but are machined and possibly subjected to a surface treatment or provided with a coating so as to form smooth bearings. The fact of blocking the shaft 70 in rotation relatively to the beam 124 avoids having to also make smooth bearings in the passage holes 103, 104. Alternatively, both beams 124, 125 are free in rotation relatively to the shaft 70.

A washer 100 is preferably mounted on the shaft 70 between the beams 124 and 125 in order to limit friction between them during their pivoting.

The shaft 70 is blocked in translation relatively to the two beams 124, 125 and also relatively to the beams 134, 135. This may be achieved by any suitable means for example an elastic ring 85 on the side of the outer beam 125 and a shoulder on the shaft 70 on the side of the inner beam 124.

But in the preferred case when the shaft 70 is blocked in rotation relatively to the beam 124, it may advantageously be resorted to a stop element attached removably to the beam 124 and interfering with the shaft 70 by shape cooperation for stopping both the translation and the rotation of the shaft 70 relatively to the beam 124.

The stop element is preferably made as a plate 90 illustrated in FIG. 10. The stop plate 10 has a notch 92 having two parallel edges and two smooth holes 91. As this is visible in FIG. 7, both smooth holes 91 are used for attaching the stop plate 90 on the reinforcement plate 81 of the beam 124 by means of screws 95 screwed into the two tapping holes made in the reinforcement plate 81 and the corresponding wall of the beam 124. The parallel edges of the notch 92 are used for engaging two parallel and diametrically opposite grooves 71 made in the shaft 70 for this purpose: cf. the local section perpendicularly to the shaft 70 at both grooves 71 of FIG. 12. The stop plate 90 will thus be engaged with the grooves 71 like a flat wrench. In this way, the stop plate 90 blocks both the shaft 70 in translation and in rotation relatively to the beam 124. FIG. 11 shows the shaft 70 in perspective: only one of the two grooves 71 is seen there for the connection of the shaft 70 with the beam 124 because of the perspective. For the same reason, only one of the grooves 71 is also seen there for the connection of the shaft 70 with the beam 134. Two grooves 72 which are not visible in FIG. 7 are also seen there as they are optional, but the usefulness will be seen later on. Further a groove 73 at each end for receiving the corresponding elastic ring 85 is seen there. It will be noted that the manufacturing of the stop plates 90 and the making of the grooves 71—and also 72 where applicable—on the shaft 70 are very simple. Alternatively, the shaft 70 is provided with a single groove 71 with which the stop plate 90 cooperates instead of the two diametrically opposite grooves 71 in which case the shape of the notch 92 of the stop plate is adapted accordingly. However, the making with two diametrically opposite grooves 71 is preferable from the mechanical point of view.

Alternatively, such a stop element removably attached to the beam 124 and interfering with the shaft 70 by shape cooperation is used for only stopping the translation of the shaft 70 relatively to the beam 124 in the case when the blocking of the rotation of one relatively to the other is not desired. For example, it is sufficient to replace the grooves 71 with a circumferential groove made in the shaft 70 intended to be engaged by the edges of the notch 92 of the stop plate 90.

Alternatively, the stop element is permanently attached onto the beam 124, but it is preferable that it is attached thereto removably since this gives the possibility advantageously of disassembling the lifting mechanism in the case of a fault of a pivot shaft or of a scissor arm in order to replace it.

Alternatively, the translation and the rotation of the shaft 70 is blocked relatively to the outer beam 125 instead of the inner beam 124 in which case the aforementioned stop element may be provided on the side of the outer beam 125 so as to be attached thereto removably.

It will be noted that the shaft 70 gives the possibility of rigidly connecting together the inner beams 124, 134, taking into account the blocking in translation of the shaft 70 relatively to the inner beams 124, 134. Both sets of parallel scissors are therefore rigidly connected to each other without resorting to spacers. Possible welds of the spacers to the scissor beams are thereby avoided, which tend to deform the beams. Further, the result of this is a gain in weight since a common shaft has a material section less than that of a spacer.

Further, resorting to a stop element, including with the shape of the stop plate 90, which has just been described may also be applied to a pivot shaft of scissor beams which is short, i.e. which only receives two scissor beams instead of four. This is for example the case of the pivot shaft in the central portion of the beams 123, 124 of the first set of scissors and of the pivot shaft in the central portion of the beams 133, 134 of the second set of scissors because a common shaft to these four beams would interfere with the lifting cylinder 4. This is also the case in our example of the central pivot shaft of the beams 125, 126 and of the central pivot shaft of the beams 135, 136 as this is distinctly seen in FIG. 13.

Moreover, the passages for the shafts 15 and 16 in the lower ends of the scissor arms of the first stage 11, and those for the shafts 17 and 18 in the upper ends of the scissor arms of the last stage 1 may advantageously be made in the same way as the passages of the pivot shafts of the beams between them. These shafts 15 to 18 may advantageously be maintained in the scissor arms, by means of stop elements interfering with these shafts in the same way as described for the pivot shafts of the scissor arms with each other, in particular by the stop plates 90.

With reference to FIGS. 13 to 15, we shall describe the mounting of an end of the actuation cylinder 4, in this case its rod, to the inner beams of scissors of the third stage 13, it being specified that the other end of the cylinder is preferably mounted in the same way to the inner beams of scissors of the first stage 11.

The rod of the cylinder 4 is mounted at each of the inner beams of scissors 126, 136 by means of a respective mounting plate 200 with a general triangular shape. Each mounting plate 200 is mounted in the same way to the relevant beam of scissors. Therefore, this will only be described for the beam 126.

FIG. 14 shows a mounting plate 200. It comprises a protrusion 201 forming a housing for receiving one end of a shaft on which is jointed the end of the rod of the cylinder 4. It comprises at each end a shaft passage hole 202, respectively 203 and two smooth holes 204, respectively 205, made on either side of the shaft passage hole.

As this is visible in FIGS. 13 and 15, an end of the mounting plate 200 is mounted on the end shaft 70 pivotally connecting the beams of scissors 123, 126 on the one hand and the beams of scissors 133, 136 on the other hand. Given that the pivoting assembly of these beams is identical—to a single exception—to the one described with reference to FIGS. 7 to 12, the same reference numbers have been used for referring to the identical elements. The only difference relatively to FIG. 7 is that the mounting plate 200 is further mounted on the shaft 70 which crosses the passage hole 203, the mounting plate 200 being sandwiched between the stop plate 90 and the reinforcement plate 81 of the beam 126. The screws 95 are screwed into the reinforcement plate 81 and the corresponding wall of the beam 126 through both the holes 91 of the stop plate 90 and the holes 205 of the mounting plate 200. Taking into account the material over-thickness of the mounting plate 200, the stop plate 90 engages with the grooves 72 of the shaft 70 provided for this purpose instead of the grooves 71. The grooves 72 are identical with the grooves 71 and are used for the same function—already described above—of blocking the shaft 70 relatively to the inner beam of scissors, by means of the stop plate 90. The grooves 72 are therefore only shifted axially relatively to the grooves 71, as this is visible in FIG. 11, in order to take into account the over-thickness of material of the mounting plate 200. Of course, the grooves 71 are not used in this case and may therefore be omitted from the shaft 70.

The other end of the mounting plate 200—which corresponds to the passage hole 202—is not mounted on a pivot shaft of beams of scissors since the mounting plate 200 does not extend as far as the central pivot shaft of the scissor beams 125, 126. This may such be the case and the mounting of this other end of the mounting plate on the central pivot shaft will be achieved in the same way as for the corresponding end of the passage hole 203 which has just been described.

In the illustrated case, the other end of the mounting plate 200 is mounted on a mounting shaft 170 dedicated to this sole purpose. The shaft 170 is received in a shaft passage made in the beam 126 which is reinforced with a reinforcement plate 180, 181 welded on each side of the beam, in the same case as for the pivot shaft passage of the beams of scissors. These reinforcement plates are moreover identical with the reinforcement plates 80A, 81A. The mounting plate 200 is mounted on the shaft 170 which crosses the passage hole 202. Maintaining in position of the mounting plate 200 against the beam 126 is ensured in the same way at its other end, a reason why the same reference numbers have been used for referring to the identical elements. In other words, the mounting plate 200 is sandwiched between the reinforcement plate 181 of beam 126 and a stop plate 90 screwed into the reinforcement plate 181 and the beam 126 with screws 95 crossing the holes 204 provided for this purpose. This stop plate 90 also cooperates with grooves—similar to the grooves 72 of the shaft 70—made in the shaft 170 for blocking the translation of the shaft 170 relatively to the beam 126. The result of this is that the stop plate 90 also maintains the shaft 170 in the beam 126.

Alternatively, both ends of the mounting plate may be mounted on a respective dedicated mounting shaft in the described way, but it is more advantageous to mount the cylinder mounting plates on at least one pivot shaft of the beams of scissors, or even two, for the sake of simplifying the manufacturing.

It will be understood that the different ways for mounting the mounting plate 200 at an arm of scissors which have just been described, may also be used in the case of a aerial work platform with simple scissors for attaching to an arm of scissors a mounting support of an end of the actuation cylinder of the scissor lifting mechanism which comprises a plate identical or similar to the mounting plate 200.

Of course, the present invention is not limited to the embodiment and alternatives described earlier and illustrated, but it may have many alternatives accessible to one skilled in the art.

It will also be understood that the fact of rigidly connecting together both sets of parallel scissors—without resorting to spacers—by means of common pivot shafts to the beams of scissors of both sets of parallel scissors and of stop elements interfering with the shafts as described above, in particular with the shape of stop plates 90, may be applied independently of the structure of the pivot shaft passages of the beams of scissors according to the invention. Thus, according to another aspect, the invention proposes an assembly of scissor arms for a scissor lifting mechanism of the work platform of an aerial work platform, comprising:

- a first scissor arm and a second scissor arm mounted together pivotally around a shaft, and
- a third arm of scissors and a fourth arm of scissors mounted together pivotally around the same shaft, wherein:

- the third and fourth arms are axially distant from the first and second arms; and
- a respective stop element is attached removably to the first and third arms and interferes with the shaft by shape cooperation for stopping the translation of the shaft relatively to the first and third arms respectively.

The first and third arms are preferentially mounted on the shaft between the second and fourth arms. Advantageously, the assembly is without any spacer extending between the first and third arms. It is advantageous that the stop elements interfere with the shaft by shape cooperation for blocking the shaft also in rotation relatively to the first arm. It is further advantageous that the shaft has at least one respective groove which is engaged, each by a respective one of the stop elements for to blocking the shaft both in translation and in rotation relatively to the first and third arms respectively. The stop elements are preferably attached to the first and third arms respectively by screws. The stop elements may advantageously be with the shape of a plate. Each of the arms is preferably formed with a tubular beam. The invention also proposes an aerial work platform comprising a chassis, a work platform and a scissor lifting mechanism mounted on the chassis and supporting the work platform for moving it in height, wherein the scissor lifting mechanism comprises at least one assembly of scissor arms according to this other aspect of the invention.

The invention claimed is:

1. An assembly of scissor arms for a scissor lifting mechanism of a work platform of an aerial work platform, comprising a first scissor arm and a second scissor arm mounted together pivotally around a shaft crossing both arms, wherein:

- each of the arms is formed with a tubular beam which has:
  - a first local reinforcement plate welded on the outer surface of a first side of the beam; and
  - a second local reinforcement plate welded on the outer surface of a second side of the beam which is opposite to the first side of the beam;
- each of the arms has:
  - a first shaft passage hole made in the first reinforcement plate and the first side of the beam, and
  - a second shaft passage hole made in the second reinforcement plate and the second side of the beam;
  - wherein:
  - the shaft is circumferentially supported in the first passage holes both by the beams and the first reinforcement plates; the shaft is circumferentially supported in the second passage holes both by the beams and the second reinforcement plates; and the shaft is free of any support inside the beams between each respective first passage hole and second passage hole.

2. The assembly according to claim 1, wherein the shaft is blocked in translation relative to both arms.

3. The assembly according to claim 2, wherein the shaft is blocked in rotation relative to the first arm.

4. The assembly according to claim 3, wherein there is a respective smooth bearing ring arranged in each of the first passage hole and the second passage hole of the second arm.

5. The assembly according to claim 2, comprising a stop element attached removably to the first arm and interfering with the shaft by shape cooperation for stopping the translation of the shaft relative to the first arm.

6. The assembly according to claim 5, wherein the stop element is attached to the first arm with screws.

7. The assembly according to claim 5, wherein the stop element is a plate.

8. The assembly according to claim 5, comprising a mounting plate for an actuator of the scissor lifting mechanism, the mounting plate being mounted to the first arm, wherein an end of the mounting plate is mounted to the first arm by means of the shaft, the mounting plate being mounted on the shaft and sandwiched between the stop element and the first arm.

9. The assembly according to claim 5, comprising:

- a mounting plate for an actuator of the scissor lifting mechanism, the mounting plate being mounted to the first arm, and
- at least one second shaft by means of which an end of the mounting plate is mounted to the first arm, wherein:
- the beam forming the first arm has:
  - a third local reinforcement plate welded on the outer surface of the first side of the beam;
  - a fourth local reinforcement plate welded on the outer surface of the second side of the beam;
  - a first passage hole of the second shaft made in the third reinforcement plate and the first side of the beam and in which the second shaft is circumferentially supported both by the beam and the third reinforcement plate; and
  - a second passage hole of the second shaft made in the fourth reinforcement plate and the second side of the beam and in which the second shaft is circumferentially supported both by the beam and the fourth reinforcement plate; and the mounting plate is mounted on the second shaft and sandwiched between the first arm and a second stop element removably attached to the first arm, the second stop element interfering with the second shaft by shape cooperation for blocking the translation of the second shaft relative to the first arm.

10. The assembly according to claim 9, wherein the second stop element is identical to the first stop element.

11. The assembly according to claim 2, comprising two other scissor arms mounted together pivotally around the shaft, the two other arms being axially distant from the first and second arms, the two other scissor arms being identical with the first and second scissor arms and maintained on the shaft in the same way as the first and second scissor arms.

12. An aerial work platform, comprising a chassis, a work platform and a scissor lifting mechanism mounted on the chassis and supporting the work platform for displacing it in height, wherein the scissor lifting mechanism comprises at least one assembly of scissor arms comprising a first scissor arm and a second scissor arm mounted together pivotally around a shaft crossing both arms, wherein;

each of the arms is formed with a tubular beam which has:

a first local reinforcement plate welded on the outer surface of a first side of the beam; and a second local reinforcement plate welded on the outer surface of a second side of the beam which is opposite to the first side of the beam;

each of the arms has:

a first shaft passage hole made in the first reinforcement plate and the first side of the beam, and a second shaft passage hole made in the second reinforcement plate and the second side of the beam;

wherein:

the shaft is circumferentially supported in the first passage holes both by the beams and the first reinforcement plates; the shaft is circumferentially supported in the second passage holes both by the beams and the second reinforcement plates; and the shaft is free of any support inside the beams between each respective first passage hole and second passage hole.

13. The aerial work platform according to claim 12, wherein:

the shaft is blocked in translation relatively to both arms, and the assembly further comprises a stop element attached removably to the first arm and interfering with the shaft by shape cooperation for stopping the translation of the shaft relatively to the first arm and for blocking the shaft in rotation relatively to the first arm.

14. The aerial work platform according to claim 13, wherein there is a respective smooth bearing ring arranged in each of the first passage hole and the second passage hole of the second arm.

15. The aerial work platform according to claim 13, further comprising a mounting plate for an actuator of the scissor lifting mechanism, the mounting plate being mounted to the first arm, wherein an end of the mounting plate is mounted to the first arm by means of the shaft, the mounting plate being mounted on the shaft and sandwiched between the stop element and the first arm.

16. An assembly of scissor arms for a scissor lifting mechanism of a work platform of an aerial work platform, comprising a first scissor arm and a second scissor arm mounted together pivotally around a shaft crossing both arms, wherein:

each of the arms is formed with a tubular beam which has:

a first local reinforcement plate welded on the outer surface of a first side of the beam; and a second local reinforcement plate welded on the outer surface of a second side of the beam which is opposite to the first side of the beam;

each of the arms has:

a first shaft passage hole made in the first reinforcement plate and the first side of the beam, and a second shaft passage hole made in the second reinforcement plate and the second side of the beam;

wherein:

the shaft is circumferentially supported in the first passage holes both by the beams and the first reinforcement plates; the shaft is circumferentially supported in the second passage holes both by the beams and the second reinforcement plates; and the shaft is free of any support inside the beams between each respective first passage hole and second passage hole and the shaft is blocked in translation relatively to both arms, and wherein the assembly further comprises a stop element attached removably to the first arm and interfering with the shaft by shape cooperation for stopping the translation of the shaft relatively to the first arm and for blocking the shaft in rotation relatively to the first arm.

17. The assembly according to claim 16, wherein the stop element is a plate.

18. The assembly according to claim 17, wherein the shaft has at least one groove engaged by the stop element for blocking the shaft both in translation and in rotation relatively to the first arm.

19. The assembly according to claim 18, wherein the stop element is attached to the first arm with screws.

20. The assembly according to claim 16, wherein the shaft has at least one groove engaged by the stop element for blocking the shaft both in translation and in rotation relatively to the first arm.

* * * * *